United States Patent [19]

Prosise et al.

[11] 4,316,070

[45] Feb. 16, 1982

[54] COOKWARE WITH LIQUID MICROWAVE ENERGY MODERATOR

[76] Inventors: Robert L. Prosise; Algis S. Leveckis; Charles L. Gunn, all c/o Ivorydale Tech. Center, Cincinnati, Ohio 45217

[21] Appl. No.: 68,357

[22] Filed: Aug. 21, 1979

[51] Int. Cl.[3] ..... H05B 6/80

[52] U.S. Cl. ..... 219/10.55 E; 219/10.55 F; 219/10.55 M; 426/107; 426/243; 428/500

[58] Field of Search ..... 219/10.55 E, 10.55 M, 219/10.55 R, 10.55 F; 426/107, 118, 127, 237, 241, 243; 427/401, 384; 428/500

[56] References Cited

U.S. PATENT DOCUMENTS

| | | | |
|---|---|---|---|
| T961,008 | 8/1977 | Hendy | 428/500 X |
| T961,009 | 8/1977 | Hendy | 428/500 X |
| 3,099,350 | 7/1963 | Hammond . | |
| 3,205,077 | 9/1965 | Hammond . | |
| 3,222,191 | 12/1965 | Steiner et al. . | |
| 3,222,210 | 7/1965 | Hammond . | |
| 3,303,049 | 2/1967 | Hill et al. . | |
| 3,419,421 | 12/1968 | Eastes . | |
| 3,809,845 | 5/1974 | Stenstrom | 219/10.55 E |
| 3,854,023 | 12/1974 | Levinson | 219/10.55 E |
| 4,015,085 | 3/1977 | Woods | 219/10.55 E |
| 4,144,438 | 3/1979 | Gelman et al. | 219/10.55 E |

FOREIGN PATENT DOCUMENTS

| | | |
|---|---|---|
| 501748 | 4/1976 | U.S.S.R. . |

*Primary Examiner*—Arthur T. Grimley

[57] ABSTRACT

A moderator for cooking foods evenly in a microwave oven is described. The moderator is in the form of an enclosure having a fluid impervious outer layer. Attached to the inside surfaces of the outer layer is a liquid film forming layer which converts a dielectric fluid placed in contact with the layer into a thin liquid film which surrounds the cooking comestible.

47 Claims, 6 Drawing Figures

COOKWARE WITH LIQUID MICROWAVE ENERGY MODERATOR

TECHNICAL FIELD

This invention relates to devices for cooking comestibles in microwave ovens and, more particularly, to devices for moderating the microwave energy prior to its interaction with the comestible to cause more even cooking.

BACKGROUND ART

Conventional microwave ovens, though possessing many advantages, suffer from an inability to heat items placed within them evenly at all points on their surface. The unevenness of the microwave oven prepared comestible is in part the result of the unevenness of the incident microwave energy. This problem can be circumvented by varying the cooking process or by incorporating an energy moderator. By varying the cooking process to periodically reposition the article being cooked, cooking evenness can be improved. However, varying the process inevitably means that greater attention is required. Thus a variety of moderators have been proposed to avoid the requirement of attention to the cooking comestible.

One approach has been to provide a mechanism which automatically repositions the food item within the microwave energy field. Rotating shelves, for example, that described in U.S. Pat. No. 3,428,773 issued Feb. 18, 1969 to Waldenfels, have been introduced to lessen the effects of nonuniform fields of microwave energy in microwave ovens. In a converse approach, the food is kept stationary and the field is "moved" or "stirred". Rotating mode stirrers, such as that disclosed in U.S. Pat. No. 3,819,900 issued June 15, 1974 to Ironfield, have been provided to lessen the non-uniformity of the field of microwave energy in microwave ovens.

Another approach has been to partially or selectively shield the item being cooked with a specially designed food container. For example, U.S. Pat. No. 3,547,661 which issued Dec. 15, 1970 to P. N. Stevenson discloses a container and food heating method where apertures of various sizes are provided on the top and bottom in registered relation. Such apertures may also be partially masked by microwave reflective material as indicated in FIGS. 1 and 3, areas 25–28. Various sizes of apertures or of partial masking ostensibly provide means for selectively heating different items at different temperatures simultaneously. U.S. Pat. No. 4,013,798 which issued Mar. 22, 1977 to Costase also discloses a selectively shielded microwave cooking structure comprising registered openings of various sizes. The use of apertures of various sizes and shapes in the top of a microwave cooking food tray which is otherwise microwave reflective is disclosed in U.S. Pat. No. 3,672,916 which issued June 27, 1972 to H. J. Vernig and U.S. Pat. No. 3,219,460 which issued Nov. 23, 1965 to E. Brown.

The prior art also includes means in the form of a cooking container for moderating the incoming microwave energy. For example, U.S. Pat. No. 4,144,438 issued on Mar. 13, 1979 to Gelman describes a microwave energy moderating bag with a foil lamina 23 perforated by an array of apertures 30 which are sufficiently large and numerous to render the bag 20 substantially transparent to microwave energy of a predetermined frequency. However, the apertures are sufficiently small that such microwave energy which passes into the bag in a microwave oven will be sufficiently moderated to precipitate uniform cooking of a foodstuff disposed therein.

Water has been used in the past to improve the evenness of the cooked foodstuff. For example, Soviet Pat. No. 501,748 issued Feb. 5, 1976 discloses a cooking bag for meat or fish which involves surrounding the food with two closed, unvented cellophane bags having water between the two bags in an amount up to 15% of the weight of the food. The food is cooked by a series of 2 to 3 minute heating cycles separated by 2 to 3 minute cooling cycles. A similar approach is to convey the food item through a water bath where it is exposed to microwave energy. Examples of such devices are disclosed in German Offenlegungsschrift Pat. No. 2,704,563 issued Aug. 25, 1977 and U.S. Pat. No. 3,809,845 issued May 7, 1974 to Stenstrom. Stenstrom discloses a thick water layer (2.5 mm.) above and below the food portion. In addition, it is known that the Litton Company of Minneapolis, Minn. is currently marketing a device known as a "Simmer Pot" which is a porous clay pot with a water absorbent clay lid which is soaked in water for 30 minutes to overnight. After soaking the lid, the food item is placed within the closed clay pot and cooked. A similar device is marketed by El Camino Products, Inc. of Penoga Park, California under the brandname Olde World Roaster.

The prior efforts to make the cooking of food items within a microwave oven more uniform are subject to a variety of shortcomings. Devices which require oven redesign are of little use to current oven owners. Devices using metallic elements are prone to arcing problems which must be avoided with concommitant increase in the cost of the product. Devices using water baths are not suitable for use in the home, and bags with water requiring short cooking cycles or long soaking cycles are inconvenient. Most importantly the prior practice in this field is subject to improvement in terms of the extent of evenness of the cooked comestible which is accomplished.

DISCLOSURE OF INVENTION

This invention relates to cookware for cooking foods evenly in microwave ovens. The cookware is a vented enclosure being microwave oven compatible to a temperature above 150° C. The enclosure has an inner layer of liquid from 4 to 120 milligrams per square centimeter, retained by a liquid film forming layer, and an adjusted technical evenness rating above zero for 10 minutes and a technical evenness rating above 0.3.

A process for microwave cooking is also disclosed. The process involves the steps of forming a discrete fluid impermeable enclosure and then placing within said enclosure a liquid film forming layer. The liquid film forming layer is then supplied with a liquid. The liquid is arranged so as to result in a significant interaction with the microwave field. The food item is placed within the liquid film forming layer and the enclosure. Finally the enclosure is placed within a microwave oven and the food item is cooked while maintaining a liquid film around the food item for at least 50% of the cooking cycle.

DETAILED DESCRIPTION OF THE INVENTION

Figure 1:
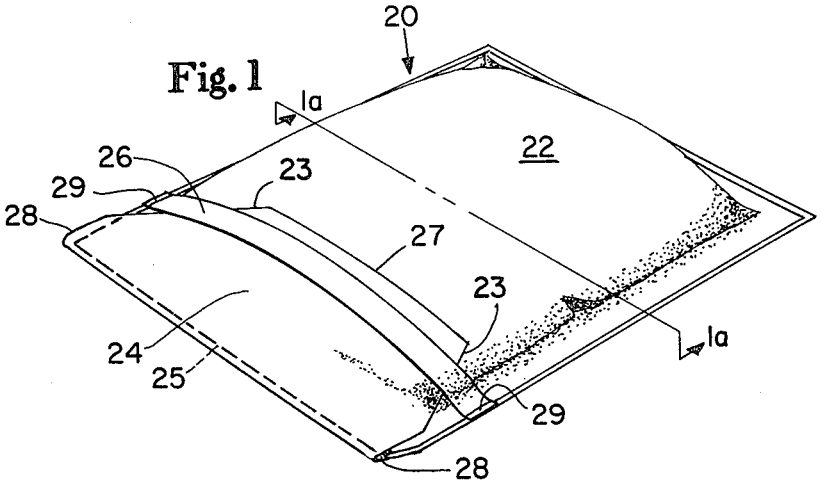
FIG. 1 is a perspective view of a cooking bag in use with a closed flap and strap closure.

Referring to the drawings wherein like reference characters are utilized for like parts throughout the several views, there is illustrated in FIG. 1 an item of microwave energy moderating cookware 20. The cookware can take the form of a bag, wrap, or container. As shown in FIG. 1, the outer surface of the cookware is a vapor impermeable polymeric film 22 in the form of a bag. The bag has a flap 24 which is held in the closed position by a retaining strap 26, having a length equal to the width of the bag and extending across the bag parallel to the opening in the bag but spaced from it.

The cookware 20 is constructed, preferably, by heat sealing two sheets of plastic film together around these overlapping edges, one sheet extending beyond the nonsealed overlapping edge of the other so as to leave a portion which will form a flap 24 to close bag opening 25 indicated in dotted lines in FIG. 1. A strip of polymeric material is then placed across the width of the bag a suitable distance from the opening of the bag to form the retaining strap 26. The ends of the retaining strap are then secured by parallel edge heat seals 29. Both sides 23 of the flap 24 are cut so that they taper at an angle of about 30° inwardly toward the end 27 of the flap. Corner vents 28 are formed in the bag between the flap retained in its closed position under the retaining strap 26 and the remainder of the bag 20.

The cookware must be vapor impermeable and waterproof and must also be microwave oven compatible. To be "microwave oven compatible", as used herein the cookware must be unaffected by temperature up to 150° C. under the conditions encountered in microwave ovens, including contact with hot food or food containers, grease and oil. More specifically a microwave oven compatible cookware must not emit noxious fumes, soften or stick, shrink in excess of 30%, shatter, burn or char below 150° C.

In addition to being microwave oven compatible, cookware 20 made of polymer film must have a Vicat softening point above 135° C. as determined by ASTM test method D1525, and a change in linear dimension of less than 10% at 100° C. as measured in accordance with ASTM test method D1204. The film also preferably has a dissipative strength as defined by ASTM standard D150 of less than 0.04 at a frequency of 1 gigahertz. Suitable polymeric materials for the film 22 are polypropylene, polyamides, polyester, polycarbonate, cellulose triacetate, ethyl cellulose, regenerated cellulose flouroplastics, polyimides, polymethylpentene, polysulfones, and polyether sulfones. The thickness of the film is not critical but a film 22 thickness of from 1 to 2 mils results in a bag of suitable strength and flexibility.

Figure 1A:
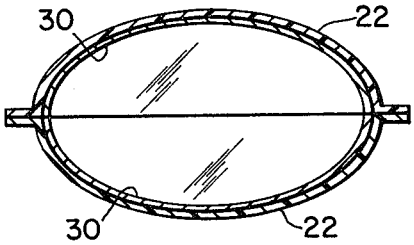
FIG. 1*a* is a cross-sectional view taken along the line 1*a*—1*a* in FIG. 1 for the embodiment with a surfactant film forming layer.
Figure 1B:
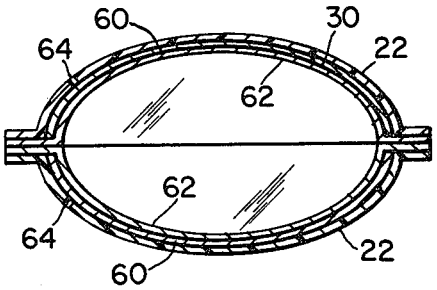
FIG. 1*b* is a cross-sectional view taken along line 1*a*—1*a* in FIG. 1 for the embodiment with an absorbent film forming layer.

To the inside surface of the film 22 is attached a liquid film forming layer 30 shown in FIGS. 1a and 1b which distributes liquid which comes in contact with it into a liquid film. The film forming layer can be composed of a water soluble coating of one or more wetting agents or a fluid retaining absorptive layer. Preferably the film forming layer extends continuously over the entire internal surface area of the film 22.

The dielectric properties of the liquid used in conjunction with the film forming layer are critical to the bag's ability to moderate or even electromagnetic fields. For cookware of convenient thickness, the liquid preferably has a dielectric constant above 2 and a loss tangent below 1.0. Water is the preferred liquid because it is effective, economical, and readily available in the form of vapor given off by the cooking food item. Other suitable dielectrics include vegetable oil, ethanol and polyols.

Figure 2:
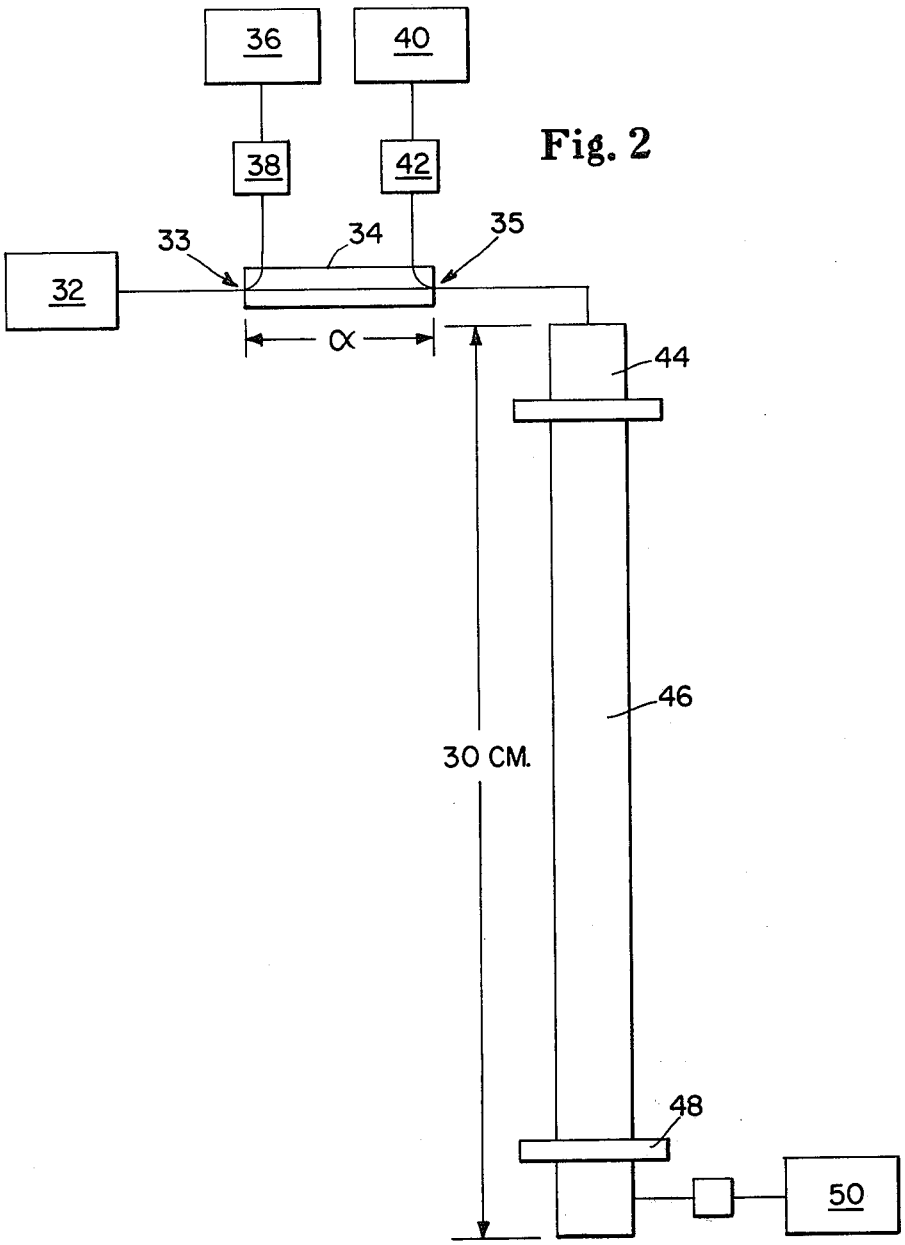
FIG. 2 is a schematic view of the waveguide used to make the measurements herein.

The film forming layer 30 together with the fluid it supports and the film 22 must have certain dielectric properties to function properly in this invention. Preferably the film 22 will have a loss tangent low enough to result in very little absorption of energy by the film itself. With a 2.45 gigahertz source, the most common microwave oven source, it is preferred that the sides of the bag have a reflectivity of at least 0.2% and an absorptivity determined by the nature of the film forming layer, as will be explained later. "Reflectivity" and "absorptivity", as used herein, are the percentage of the incident power reflected and absorbed respectively, by microwave energy incident upon the bag side. A conventional wave guide schematically shown in FIG. 2 is used to measure these values.

The energy from a 2.45 gigahertz source 32 entering a 1 to 4 gigahertz Model 3022 dual directional coaxial coupler 34 made by The Narda Microwave Corporation, Plainview, N.Y., is measured with a first power meter 36 connected to the coupler by a power sensor 38. The energy input at the other end of the dual directional coupler is measured by a second power meter 40 connected to the coupler by a power sensor 42. The input 33, to the first power meter 36, is spaced a distance $\alpha$ equal to one quarter of the wavelength of the source energy from the input 35, to the second power meter 40. In this case the distance $\alpha$ between the two inputs is about 3 centimeters. Then the reading on the first power meter 36 is the incident power and the reading on the second power meter 40 is the reflected power. The output of the dual directional coupler feeds a coax wave guide adapter 44 which connects the coupler to a 30 centimeter aluminum wave guide 46.

The sample 48 is placed in the vertically oriented wave guide 46 and the power transmitted is measured by a power meter 50 at the end of the wave guide. Reflectivity is determined by dividing the measurement of reflected power measured on power meter 40 by the incident power measured on power meter 36. Absorptivity is calculated by subtracting from incident power the reflected power measured on power meter 40 and also subtracting the transmitted power measured on power meter 50 and then dividing the resultant quantity by incident power measured on power meter 36.

The sample is prepared by attaching the film forming layer to be tested to a polypropylene film patch. If the sample is designed to be charged by condensed cooking vapors, a representative water charge of 10 mg./cm.$^2$ is dispersed uniformly across the film forming layer. The sample is then placed in a frame holder and slid into the waveguide at 48 with the film forming layer pointing upwards towards the incoming microwave energy. The holder is a rectangular aluminum frame and the film patch is secured within the frame by silicone adhesive.

The evenness of the microwave energy field incident to the comestible after passing through the moderator can be quantified by a technical evenness rating (TER) or by a cooking evenness rating (CER). TER measures the variation of heating in a standardized water load. CER measures the evenness of a standardized cooked comestible. It has been found that CER scores correspond directly to TER scores if the moderating enclosure is sufficiently fluid impervious to maintain the needd liquid layer over a significant portion of the cooking cycle.

The technical evenness rating is determined by a simple test which examines the variation of temperature at different locations within the oven. Two low dielectric plastic ice cube trays with 14 cells each are used to form a 4×7 array of isolated cells in the oven. Thirty grams of distilled water is placed in each cell as an energy absorbing load. The trays are placed side by side within a prototype bag which is about 36 centimeters wide by 34 centimeters long and the bag is placed in the microwave oven set at its high or full power setting.

In an alternate method which eliminates the need for a bag, a film patch with a liquid film forming layer attached to the upper surface of the patch is placed on a glass sheet, both the patch and the glass sheet being 30 centimeters by 36 centimeters. The glass sheet is centered over and covers the ice cube trays. A dike is attached to the glass sheet about 2 centimeters inwardly of its outer perimeter to contain the liquid layer. The dike is about 0.5 centimeters high and 0.5 centimeters wide. It is made of a nonlossy plastic and is glued to the sheet by silicone adhesive. The film patch is then placed over the glass sheet and its dike, so as to form the film patch into a very slight cup shape. By experiment, it has been found that the rating using the bag is equal to 1.14 times the rating with the patch. When technical evenness rating is given herein the bag test is specified unless explicitly stated otherwise.

Under either method the trays are centered in the oven on the floor with their length parallel to the back wall of the oven. All tests conducted herein utilize a Litton Model 419 oven available from Litton Industries of Minneapolis, Minn. After 3 minutes the temperature of the water in each cell is measured quickly. The test is repeated and an average final temperature for each cell for both runs is then determined. A temperature variance is then calculated by determining a grand average temperature for all the cells, X1, a standard deviation in temperature for the test, S, and a standard deviation of temperature with the open oven $S_0$. The technical evenness rating is then equal to $1-S^2/S_0^2$.

It is also important to known the amount of cooking power which reaches the load after passing through the moderating enclosure which is termed "moderated power", as a percentage of that power which is termed "unmoderated power" which would reach the same load without a moderator around the load. This is because the percentage of moderated power determines the added time needed to cook food within the moderator compared to the time needed without a moderator. The percentage of moderated power reaching the load is determined by dividing the power which reaches the water in the ice cube trays with the prototype by the power to the water in the trays without the prototype. Power to the load, P, is given by the following equation:

$$P=(X1-Ti)W/t;$$

where

X1 is the grand average temperature of the test,

W is the weight of the load, t is the time of the test, and

Ti is the initial temperature of the water in the cells.

With more than 80% moderated power, cooking time will be lengthened by no more than about 10%. A 10% cooking time increase usually amounts to no more than a minute or two increase in cooking time.

The cooking evenness rating is determined by actually cooking a standardized meatloaf. The meatloaf is composed of 678 grams of lean groundbeef mixed with the following: ½ cup milk, ¼ cup ketchup, ½ cup cracker crumbs, ¾ cup chopped onion, ½ teaspoon salt, ½ teaspoon black pepper, and 1 egg.

The uncooked meatloaf is formed into a rounded rectangular solid 20 centimeters long, 12 centimeters wide, and 12 centimeters high. It is placed in a 22 centimeter circular nonlossy dish which is then inserted in a prototype cooking bag. The meatloaf is cooked on the full power setting of the oven, until the meatloaf reaches a temperature of 71° C., at its center.

The meatloaf is then graded for evenness of cooking by examining for burned or dry areas. From a perfect score of 25, 4 to 10 are subtracted for partial surface burns per meatloaf side and from 1 to 4 for partial dryness or toughness per meatloaf side are subtracted.

Figure 3:
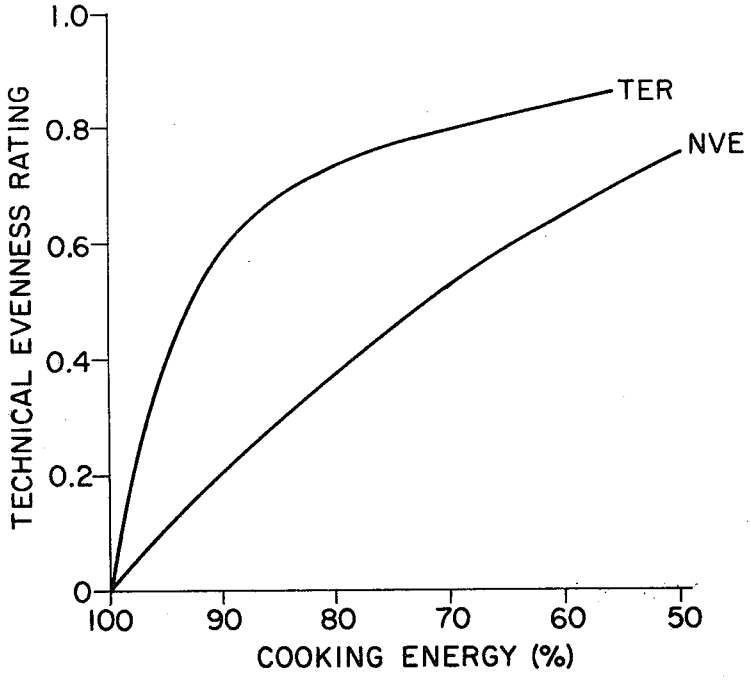
FIG. 3 is a plot of technical evenness versus cooking energy.
Figure 4:
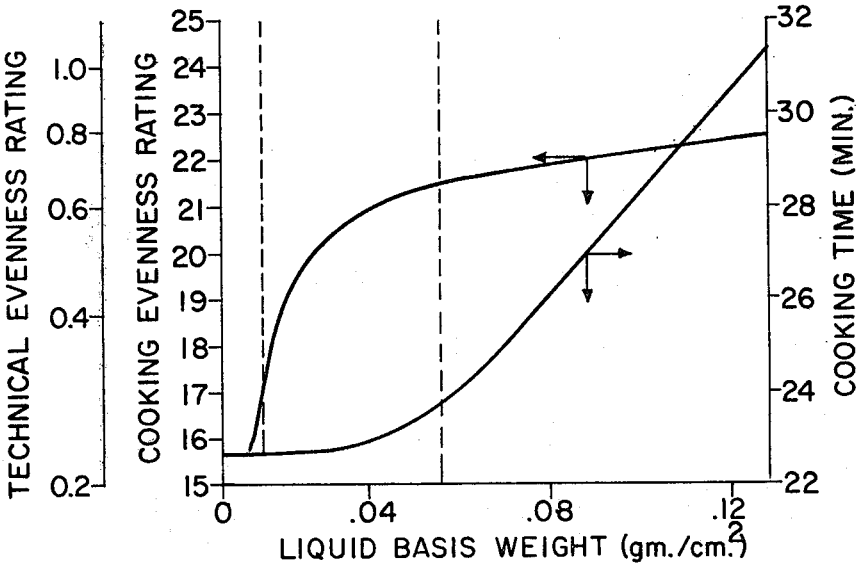
FIG. 4 is a plot of liquid basis weight against technical evenness rating and cooking time on double vertical axes.

The critical nature of the thickness of the liquid layer collected in the film forming layer is illustrated by FIGS. 3 and 4. Although water is used as the liquid and an absorbent substrate as the film forming layer in generating the curves of FIGS. 3 and 4, the curves are indicative of the general relationships which exist. In FIG. 3 the evenness of the microwave energy after passing through one side of a bag is plotted against the amount of energy reaching the load as a percentage labeled "% cooking energy" of the amount of energy to the load at full power without a moderator. A technical evenness rating of 1.0 corresponds to microwave energy which is of equal intensity at all points on the load. An evenness rating of 0 on the other hand corresponds to an open oven without a moderator. It can be seen that with the liquid moderator very high evenness can be achieved without significantly decreasing the percentage of energy to the load. This in turn means that the microwave energy can be moderated resulting in more even cooking without significant loss in cooking time. FIG. 4 illustrates this point. FIG. 4 is a plot of evenness and cooking time versus the amount of liquid, in this case water, in a cooking bag. The amount of water in the bag is expressed in terms of liquid basis weight. This measure is determined by dividing the weight of liquid held by the film forming layer by the interior surface area of the film forming layer. It can be seen that the flat region of the cooking time curve corresponds to points of high evenness; thus there is a narrow range in which evenness can be achieved without loss of cooking time. This region is indicated by two parallel dotted lines in FIG. 4. In summary, it can be appreciated that more even fields can be achieved by a relatively thin liquid film without unduly lengthening cooking time.

Returning to FIG. 3, a natural variance evenness is also indicated on the plot of evenness rating versus percentage of energy to the load. The natural variance evenness (NVE) is that evenness which results from placing a lossy dielectric material in the path of microwave energy. It corresponds to the decrease in energy to the load resulting in a proportional decrease in the variation of temperature on the load, undesirably evenning the field by wasting incident power. The natural variance evenness (NVE) is given by the following equation:

$$NVE = 1 - (P/Po)^2$$

where

P = moderated power, and

Po = unmoderated power (560 watts with oven used herein).

Thus the region above the NVE curve of FIG. 3 is the evenning which results from moderation of electromagnetic energy above and beyond the moderation which results solely from the reduction of the power to the load caused by the liquid surrounding the load.

The extent of this beneficial evenning is given by the quantity, "adjusted technical evenness", (ATE). ATE is the difference between the technical evenness rating and the natural variance evenness (NVE). It can be calculated from the equation $$ATE = (P/Po)^2 - (S/So)^2.$$

The ability of a moderator to achieve a uniformly cooked comestible without unduly lengthening cooking time can be estimated by comparing the ATE after 3 and 10 minutes. If the ATE remains above zero after 10 minutes the moderator will be capable of cooking evenly in most cooking situations encountered in the home.

In general a technical evenness rating of greater than 0.4 with more than 80% moderated power over 50% of the cooking cycle results in a significant increase in evenness of the cooked food item without a significant change in cooking time. An adjusted technical evenness greater than 0 results in a benefit in that evenness is improved beyond that due to the decrease in energy to the load. In effect the more evenly cooked product results without undue energy wastage and increased cooking time.

In the most preferred embodiment the film forming layer 30 is a layer of a water soluble wetting agent which is coated on the inside surface of the film as shown in FIG. 1*a*. As used herein, the term "wetting agent" includes emulsifiers, surfactants, and detergents. Preferably an aqueous solution of the wetting agent is prepared and coated on the film by spraying, dabbing, brushing, or any other conventional application technique. Any surfactant which is nontoxic is suitable for use in this invention, but anionic, and nonionic surfactants are preferred. A dry wetting agent coating weight in excess of the critical micelle concentration for the wetting agent and in general from 0.00075 to 0.15 mg./cm.$^2$ is preferred. It is preferred to use surfactants with low critical micelle concentrations and in general those with critical micelle concentrations below 0.003 mg./cm.$^2$ at a water level of 10 mg./cm.$^2$ are preferred. Above 1.5 mg./cm.$^2$ most wetting agents become pasty and difficult to apply and less effective after application. However, any dry weight above 0.00075 mg./cm.$^2$ will serve to moderate the electromagnetic field to some extent.

This embodiment is suitably implemented as a self-charging moderator. That is, water is collected in the film forming layer as condensation of the vapors given off from the food item as it cooks. Foodstuffs which give off enough water to be cooked in a selfcharged bag include roasts, meatloafs, and most other meat items. Other less liquid foodstuffs can be cooked in a self-charged bag by adding a suitable charge of water to the bag. In tests conducted with meatloafs made as described previously herein it was found that the water condensed in the film forming layer increased approximately linearly at a rate of about 1 mg./cm.$^2$ per minute until 14 minutes or halfway through the cooking cycle. Then no additional water was absorbed for about 7 minutes corresponding to the third quarter of the cooking cycle. The fourth quarter of the cooking cycle or after 20 minutes the water was collected rapidly, at a rate of about 1.5 mg./cm.$^2$ per minute. The bag averaged about 17 mg./cm.$^2$ of water over the cooking cycle but held 17 mg./cm.$^2$ or less for 75% of the cooking cycle. Preferably the bag will not hold more than 65 mg./cm.$^2$ in the film forming layer for more than 25% of the cooking cycle, but will retain a level of at least 7 mg./cm.$^2$ within a half of the cooking cycle or 15 minutes whichever is shorter.

Alternatively the film forming layer can be enclosed and liquid added directly. Preferably enough water is added to form a layer of from 7 to 65 mg./cm.$^2$ of water. Water may be added to the bag by the manufacturer or the consumer. The consumer charged bag would advantageously be charged through the bag opening. A layer of porous film is preferably secured over the surfactant layer to distribute the water to the surfactant layer uniformly without displacing the surfactant. Thus a consumer would add a liquid through the bag opening and slosh it around while holding the bag opening closed. A manufacturer charged bag preferably would have the surfactant and liquid layer enclosed between two polymeric films. A vent would be necessary between the liquid layer and the bag interior or exterior on each bag side during cooking.

It is believed that a wetting agent performs two functions as the film forming layer. Firstly, the wetting agent serves to spread the liquid into an essentially continuous very thin film. Secondly, the wetting agent modifies the dielectric properties of the liquid by decreasing the dielectric constant and increasing the loss tangent of the liquid. In so doing, the wetting agent helps to moderate the electromagnetic field. It has been found that wetting agent containing water layers generally perform more effectively than the same amount of water without wetting agent, held by an absorbent film forming layer. To be effective the aqueous solution must have a reflectivity of at least 0.2%. If the wetting agent is mixed with other components, the reflectivity of the layer still must be at least 0.2% but components other than wetting agent can be added to raise the reflectivity of the layer. Preferably the difference in the absorptivity of the unwetted and wetted films is less than 5% and more than 0.6%.

Suitable anionic surfactants include alkali and alkaline earth salts of compounds containing hydrophilic groups, such as sulfated fatty alcohols, sulfonated aromatic hydrocarbons, sulfonated alkyl hydrocarbons, sulfated ethers derived from fatty alcohols and those derived from alkyl phenols, sulfated fatty acid esters, sulfuric acid esters, phosphoric acid esters and products obtained by the saponification of fats and vegetable oils. Examples of suitable anionic agents include sodium lauryl sulfate, magnesium lauryl sulfate, sodium dodecyl benzene sulfonate, sodium dioctyl sulfosuccinate, sodium nonyl phenyl hydroxy poly(oxyethylene) sulfate and other compounds, such as, for example, the commercial products Tergex AOS (alpha olefin sulfonate), Texapon 130 (sodium ethoxy ether sulfate), Duponol C (sodium lauryl sulfate), Stepanol WA (sodium lauryl sulfate), Monowet MO-70 (sodium dioctyl sulfosuccinate), Detergent S-100 (phosphoric acid esters of alkyl phenol polyethoxy ethanol), Aquarex SMO (sulfated methyl oleate), Aresklene (disodium dibutyl-ortho-phenylphenoldisulfonate), Alipal CO-433 (sodium salt of sulfate ester of alkyl phenyl poly (ethyleneoxy) ethanol), and the like and mixtures thereof.

Preferred anionic surfactants are sodium lauryl sulfate applied in the range of 0.015 mg./cm.$^2$ to 0.16 mg./cm.$^2$, and sodium dioctyl sulfosuccinate at a level of 0.0015 mg./cm.$^2$ to 0.16 mg./cm.$^2$. In general, the preferred level of anionic surfactant if used alone is 0.015 mg./cm.$^2$ to 1.6 mg./cm.$^2$ and most preferably between 0.015 mg./cm.$^2$ to 0.16 mg./cm.$^2$.

Suitable nonionic wetting agents include condensation products of fatty materials and their derivatives with ethylene oxide, condensation products of phenolic compounds with ethylene oxide, condensation products of phenolic compounds with propylene oxide, poly (oxypropylene) polymers and poly (oxyethylene) polymers and their copolymers, condensation products of sorbitan esters with ethylene oxide, mono and diglycerides of fatty acids and their derivatives, lecithin and its derivatives, and propylene glycol fatty acid esters. In addition, certain low molecular weight polymers such as cellulose and protein modified compounds would also be suitable. Suitable nonionic agents include Neodol 2.3-6.5 (primary alcohol ethoxylate), Tweens (polyoxyethylene sorbitan fatty acid esters), Spans (sorbitan fatty acid esters), Aldo (monoglyceride), Cetodan (acetylated monoglyceride), Plurionic (ethylene oxide polypropylene oxide condensation). Plurafac (modified ethoxylated straight chain alcohol), Alkasurf (nonyl phenol ethoxylate), Alcolex (soybean lecithin), Mapeg 4000 MS (polyethylene glycol monostearate), Methocel F-50 (hydroxy propyl methyl cellulose), and Maypon 4-C (protein condensation with coco fatty acid). Preferred nonionic surfactants and emulsifiers for use in this invention are Tween 60, Tween 20, polyoxyethylene (6) stearyl ether and Neodol 2.3-6.5 applied at the level of 0.0015 mg./cm.$^2$ to 0.15 mg./cm.$^2$.

As is well known in the art these surfactants can be combined and mixed to achieve special results on certain substrates. Anionic and nonionic surfactants and emulsifiers can be mixed to optimize their ability to spread water and adhere to polymeric film surfaces.

Water soluble or partially water soluble film formers can be used with surfactant coatings to improve the wetting action, dissolving rate, and resistance to abrasive removal of the surfactant. Suitable water soluble film formers are water soluble polymers such as polyvinyl alcohol, polyacrylate, polyoxyethylene, modified cellulose and protein compounds, plant hydrocolloids, such as corrageenan, furcellenan, xantham, gum arabic, modified starch, and gelatins.

The performance of the wetting agent coated film can be improved by using known techniques for making hydrophobic surfaces more hydrophilic before applying the wetting agent. These treatments make it easier to coat the film and increase the water spreading capability of the wetting agent treated polymeric film. Suitable treatments include corona discharge and flame treatment. Also the surface may be chemically etched or mechanically abraded to form small capillary channels on the film surface. In addition wetting agents can be incorporated into the resin used to form the film.

Electrolytes may be added to the aqueous wetting agent solution to improve the moderating effect of the wetting agent, and to reduce surface tension and critical micelle concentration of the wetting agent in water solutions. Suitable electrolytes are sodium chloride, calcium chloride, and tetrasodium pyrophosphate. It is preferred that an electrolyte level of from 0.0003 mg./cm.$^2$ to 0.0775 mg./cm.$^2$ be used and a level of about 0.01 mg./cm.$^2$ is most preferred.

A spacing sheet may be attached to the enclosure so as to separate the surfactant layer and the foodstuff. This sheet may be advantageously made of a film which is vapor permeable but substantially liquid impermeable in one direction so that vapors from the food pass through the sheet but condensation remains in the film forming layer. One such sheet is an embossed apertured film having regularly spaced cones formed in the film, the apexes of the cones being apertured. It is described (No. 22 in FIG. 4) in U.S. Pat. No. 3,929,135 issued to Thompson on Dec. 30, 1975. This patent is hereby expressly incorporated by reference herein. This sheet is also advantageous as a porous film in a consumer charged embodiment. The sheet may be secured to the film 22 by spaced spot heat seals.

Without intending to be limited by theory, applicants believe that the application of wetting agent at levels in excess of the critical micelle concentration is beneficial because only part of the applied surfactant goes in solution while the rest remains in a crystalline phase on the film surface. This thin film of crystalline surfactant on the surface of the film, it is believed, gives the surfactant layer a high reflectivity and causes the layer to function particularly effectively in this invention. The addition of an electrolyte such as salt reduces the critical micelle concentration in addition to altering the reflectivity of the solution and therefore results in more rapid spreading of water and more rapid and more extensive crystalline phase formation.

In another preferred embodiment the film forming layer 30 is an absorbent substrate. The absorbent substrate holds the liquid which preferably is water in what amounts to a film.

The preferred structure is shown in FIG. 1b. The bag 20 acts as the film layer 22 which supports film forming layer 30. The film forming layer 30 is made up of an absorbent pad 60 and a fluid impermeable inner film 62. Preferably two separate absorbent sheets are used each covering one side of the bag and meeting at the bag edges. Suitable absorbents for the absorbent pad 60 include paper, tissue, cellulosic films or fabrics, and hydrophilic nonwoven fabrics and films. If paper is used, a thickness of from 0.125 to 0.5 millimeters is preferred. If cellulose nonwoven is used, a thickness of less than 1.5 millimeters is preferred. Regardless of its composition, a pad 60 should retain from no less than 3.7 to no more than 120 mg./cm.$^2$ of liquid. It is most preferred that the absorbent pad retain from 20 to 55 mg./cm.$^2$ of liquid. For convenience the pad can be chosen so that its absorptive capacity, the amount of liquid held when saturated, is the desired amount of liquid. This simplifies the addition of the correct amount of liquid.

The outer film layer 22 is provided with a vent hole 64 on each side of the bag to release the vapor pressure built up during microwave heating. The impermeability of the film 22 and the size of the vent 64 is preferably such that at least 7 mg./cm.$^2$ of water is retained inside the bag for 15 minutes with the oven on its full power setting. The absorbent layer should not maintain more than 50 mg./cm.$^2$ of liquid for more than 15 minutes or 25% of the cooking cycle, whichever is longest.

An electrolyte may be added to the absorbent pad. Suitable electrolytes include inorganic salts such as sodium chloride and calcium chloride. A wetting agent such as that described with respect to the prior embodiment may also be added. The addition of an electrolyte to the water in the absorbent pad increases the technical evenness rating of the structure but also can increase the cooking time. This is because the electrolytes absorb a greater proportion of the incoming energy to the load than water because of their higher loss tangent. The product containing from between 4.5 mg./cm.$^2$ to 6 mg./cm.$^2$ of a 3% sodium chloride solution is preferred. The addition of a higher concentration of electrolytes generally brings technical evenness rating closer to natural variance evenness and results in decreased energy to the load while the provision of a lower concentration shifts the technical evenness rating versus percent cooking energy curve downwardly towards the natural variance curve.

The bag may also be made so that it can be charged by the consumer. This can be accomplished by eliminating the fluid impermeable inner film 62 and the vent 64. The consumer adds the fluid to the bag through the bag opening and then shakes the bag to spread the water. The vents 28 provide adequate venting. Alternately the fluid impermeable inner film 62 may be replaced by a vapor permeable film which allows liquid to pass in only one direction. Then the liquid may be added to the bag through the interior and will be retained in the absorbent layer thereafter if the unidirectionally permeable film is oriented properly. Such a film is described in the Thompson patent incorporated by reference herein earlier. Still another means for allowing the consumer to fill the bag would be to provide a filling valve on each side of the bag.

It is preferred that the absorbent bag have a reflectivity of greater than 0.6% and a difference in absorptivity between wetted and unwetted pads of greater than 5%. Most preferably the bag has a technical evenness rating above 0.4 and a percent moderated power above 80%.

Regardless of the kind of film forming layer used, it is preferred that the film forming layer 30 result in a continuous uninterrupted layer of liquid being formed completely around the food item being cooked. However, it has been found that it is not necessary that the liquid layer formed be geometrically continuous to cause significant interaction with the microwave field, but only that it be continuous as seen by microwave energy. A significant interaction occurs when a technical evenness rating of 0.3 or above is achieved. For example, it has been found that intersecting grid networks of spaced liquid strips or uniformly arranged spots are effective in moderating fields. In effect, regions of liquid if properly spaced and arranged to interact with the incident energy will perform similarly to a geometrically continuous film. However, while the film forming layer need not be geometrically continuous, it must provide sufficient connected area to be seen as continuous by the incident microwave energy field. For given cookware sizes a minimum amount of film forming surface can be determined by experiment. Then the film forming surface can be arranged around the food item in spots or strips as desired. It is preferred to situate the spots or strips at areas of high field intensity such as points, edges and corners on the enclosure.

The following examples illustrate and expand on the practice of this invention and describe its important parameters.

EXAMPLE I

Treated films were made from a 1.5 mil sheet of polypropylene film having a melting temperature of 161° C. measured by a differential scanning calorimeter and a dissipative strength of 0.0003. The film was coated on one side by spraying an aqueous solution of one of two nonionic surfactants. The surfactant was applied uniformly across the surface of film. The coating was then dried at room temperature.

Some of the film was formed into bags as described herein and illustrated in FIG. 1, having a length of 41 centimeters and a width of 35 centimeters. The bags each had a flap and strap closure, as described herein, the strap having a length equal to the bag width. These bags were used to conduct cooking tests. Technical evenness rating was determined using the patch test. The equivalent value for the bag test is given in parentheses in Examples I–III. Reflectivity (%R) and absorptivity (%A) were determined as described earlier herein.

Treated films were made with surfactant levels of from 0–0.15 mg./cm.$^2$. One of the surfactants tested was C18E8 which is an ethoxylated fatty alcohol purchased from Jefferson Chemical Company of Houston, Texas. The other surfactant was Tween 60, a polyoxyalkalene sorbitan fatty acid ester purchased from ICI—United States of Wilmington, Del.

The performance of these films was evaluated and the results are summarized in the following chart.

| C18E8 | | | | | |
|---|---|---|---|---|---|
| Surfactant Dry Weight mg./cm.$^2$ | 0 | .0015 | .015 | .078 | .15 |
| TER | .04 | .37(.42) | .42(.46) | .6(.68) | .65(.73) |
| % Moderated Power | 100% | 94% | 94% | 89% | 74% |
| CER | 13.75 | — | — | 17.5 | — |
| %R | 0 | .2 | .9 | .4 | 1.4 |
| %A | 0 | 1.0 | 1.8 | 1.2 | 3.7 |

| TWEEN 60 | | | | |
|---|---|---|---|---|
| Surfactant Dry Weight mg./cm.$^2$ | .0015 | .015 | .078 | .15 |
| TER | .09 | .25(.29) | .4(.46) | .4(.46) |
| % Moderated Power | 98% | 97% | 88% | 83% |
| CER | — | — | — | — |
| %R | .2 | .9 | .6 | 1.2 |
| %A | 1.3 | 2.2 | 1.7 | 2.7 |

From the chart it is seen that a surfactant weight of from 0.0015 to 0.15 milligrams per square centimeter provides an acceptable value for technical evenness for C18E8. In addition, it is apparent that a level of 0.078 milligrams per square centimeter of C18E8 results in the best return in terms of technical evenness rating for the amount of surfactant used and this level would be preferred. It delivers a substantial benefit in terms of cooked product giving a CER of 17.5 compared to 13.75 for the plain bag without surfactant. This level of surfactant results in a reflectivity well above 0.2. However, at a level of 0.15 mg./cm.$^2$ the percent moderated power is slightly less than 80% and thus higher levels of surfactant would not be preferred.

With Tween 60 a level of 0.0015 mg./cm.$^2$ is ineffective and 0.015 mg./cm.$^2$ is above the range needed to be effective. At higher levels effectiveness improves with a level of about 0.078 mg./cm.$^2$ being preferred with this surfactant.

It can be concluded that both surfactants are capable of delivering a significantly better cooked product without significantly increasing cooking time.

EXAMPLE II

Cooking bags were made in accordance with Example I except that anionic surfactants were used. One of the surfactants was sodium lauryl sulfate purchased from Stepan Chemical Company of Northfield, Ill., marketed under the brandname Stapanol WA-100. The other surfactant was sodium dioctylsulfosuccinate purchased from Mono Industries, of Patterson, N.J. marketed under the brandname Monowet.

The results of cooking and waveguide tests are collected in the following table.

| Surfactant | Monowet | | |
|---|---|---|---|
| Dry Weight mg./cm.$^2$ | .0015 | .015 | .15 |
| TER | .24(.28) | .3(.34) | .33(.38) |
| CER | — | 15.75 | — |
| %R | 0 | 2.0 | 3 |
| %A | .3 | 2.6 | 4.4 |
| % Moderated Power | 98 | 91 | 97 |

| Surfactant | Stepanol | | | |
|---|---|---|---|---|
| Dry Weight mg./cm.$^2$ | .0015 | .015 | .15 | 1.5 |
| TER | .20(.23) | .29(.33) | .5(.57) | |
| CER | — | 14.25 | — | — |
| %R | .3 | .6 | 1.6 | — |
| %A | 1.4 | 1.6 | 3.1 | — |
| % Moderated Power | 98 | 93 | 95 | — |

The data collected shows that the level needed to be effective with both anionic surfactants is generally higher than that used with the nonionic surfactant C18E8. While a level of 0.0015 mg./cm.$^2$ was effective with the nonionic surfactant C18E8, the two anionic surfactants performed comparably to the nonionic surfactant Tween 60. However, even at a level of 0.15 mg./cm.$^2$ the anionic surfactant Monowet just reaches the preferred range of technical evenness rating. Technical evenness rating does appear to increase as the level of surfactant increases from 0.0015 to 0.15 mg./cm.$^2$. A level of 0.015 mg./cm.$^2$ gives the best return for surfactant invested with Monowet while a level of 0.15 mg./cm.$^2$ gives the best return with sodium lauryl sulfate.

It can be seen that at a level of 0.015 mg./cm.$^2$ a significant benefit over an uncoated bag in terms of cooked product (See Example I) is shown only by Monowet, while some benefit in cooked product is observed with the sodium lauryl sulfate at 0.015 mg./cm.$^2$ despite the closeness of the TER of the two surfactants at that level. It can be presumed from technical evenness results that the cooked product quality would be much better at higher surfactant levels.

Again it can be concluded from cooking and technical evenness results that both surfactants are capable of delivering a significantly better cooked product without significantly increasing cooking time.

EXAMPLE III

Films and cooking bags were prepared as described in Example I except that the anionic surfactant Monowet was applied to the film in an aqueous solution containing an electrolyte, sodium chloride. Two different levels of surfactant were used with different levels of electrolyte to determine the effect of the mixture of the two.

The results of the waveguide and cooking tests were as follows:

| Surfactant level mg./cm$^2$ | 0 | .015 | .015 | .0015 | .0015 | .0015 |
|---|---|---|---|---|---|---|
| Salt level mg./cm.$^2$ | 0 | 0 | .01 | 0 | .01 | .001 |
| TER | .04 | .3(.34) | .47(.54) | .25(.29) | .46(.52) | .13 |
| CER | 13.75 | 15.75 | 16.0 | — | — | — |
| %R | 0 | .2 | .9 | 0 | .9 | 1.0 |
| %A | 0 | 2.6 | 2.5 | 3.7 | 6.1 | 5.7 |

The data shows that at a level above 0.01 mg./cm.$^2$ salt drastically improves the performance of the surfactant at a level of 0.015 or 0.0015 mg./cm.$^2$. This improvement in technical evenness rating parallels the increase in reflectivity which occurs with salt addition. However, the data appears to indicate that cooking evenness does not noticeably improve. The greatest improvement in technical evenness rating for salt applied generally occurs at about 0.01 mg./cm.$^2$ of salt.

EXAMPLE IV

Cooking bags pre-charged with water were constructed with a variety of absorbent film forming layers. The absorbent layer was sandwiched between a pair of polypropylene films and the exterior film had a 1.6 mm. vent hole to the bag exterior in the lower corner of each side of the bag. Each bag side contained an identical absorbent pad. Each bag was otherwise identical to that described in Example I except that the bags were 36 centimeters in length by 34 centimeters in width.

Bag prototypes were constructed with various absorbent pads and tested for absorption capacity, cooking evenness, and reflection, absorption, and transmission. The results of these tests are compiled in the following table.

| | Towel * | Tissue ** | Napkin *** | Towel * | Cellulose Nonwoven **** | |
|---|---|---|---|---|---|---|
| Degree of saturation | 0 | 50% | 100% | 50% | 100% | 66% |
| Amt. of water (mg./cm.$^2$) | 0 | 6.1 | 12.2 | 29.6 | 61.2 | 120.5 |
| TER | .14 | .25 | .4 | .7 | .74 | .72 |
| %R | 0 | — | 6.5 | 21.6 | 52.6 | — |
| %A | 5 | — | 9.7 | 14.8 | 20.9 | — |

-continued

| | Towel * | Tissue ** | Napkin *** | Towel * | | Cellulose Nonwoven **** |
|---|---|---|---|---|---|---|
| %T | 95 | — | 83.8 | 63.6 | 76.5 | — |
| CER | 15.5 | 15.5 | 19.5 | 21.5 | 20.5 | 22.5 |
| Cooking Time (min.) | 23 | 23 | 23 | 22 | 24 | 32 |
| Dry thickness (mm.) | Vary | .076 | .140 | .457 | .711 | 1.42 |
| Maximum absorbent capacity (g/cm.$^2$) | Vary | .0105 | .0123 | .0614 | .0614 | .186 |

*All towels, Scott Paper Co., Green Bay, Wisconsin, Wyp-All brand.
**Puffs' Brand, Procter & Gamble, Cincinnati, Ohio.
***Crown Linen Soft Brand, Napkin, Crown Zellerbach, S.F., California.
****Dry lap, Buckeye Cellulose Corp., Cincinnati, Ohio.

The results demonstrate that technical evenness rating peaks with the saturated towel having an absorptive capacity of 0.0614 gm./cm.$^2$. However, thereafter increasing the amount of water retention seriously increases cooking time. Below about 6.1 mg./cm.$^2$ of water or an absorbent capacity of 0.0105 g./cm.$^2$, the technical evenness rating is not significantly improved as represented by the napkin. With an absorbent capacity of 0.0123 g./cm.$^2$, the technical evenness rating is significantly improved. It can be seen that cooking evenness rating generally substantiates the technical evenness ratings.

In terms of absorptivity and reflectivity it can be seen that the effective prototypes have reflectivities well in excess of 0.5% and absorptivities in excess of 4%.

In summary, at a water level above 12 mg./cm.$^2$, it can be seen that a very significant improvement in cooking evenness can be achieved without affecting cooking time.

EXAMPLE V

Cooking bags were constructed in accordance with the tissue embodiment of Example IV, except that salt was added to 15 grams of water in the absorbent pad in 3% and 25% salt solutions. The results are compiled in the following table.

| Substrate Degree of saturation | Napkin 100% | Tissue 100% | Tissue 100% |
|---|---|---|---|
| Amount of water mg./cm.$^2$ | 6.1 | 6.1 | 6.1 |
| Amount salt | 0 | 3% | 25% |
| % R | 1.2 | 1.7 | 4.9 |
| %T | 91.7 | 82.8 | 58.1 |
| %A | 7.1–3.8* | 15.5–3.8 | 37–3.8 |
| % Moderated Power | 95% | 87% | 74% |
| TER | .27 | .40 | .50 |

(*3.8 open waveguide absorptivity)

The results demonstrate that the addition of salt dramatically improves the technical evenness rating. The 3% salt solution gives much better technical evenness than a bag with the same amount of water and no salt and the bag with 25% salt demonstrates better evenness than a bag with the same amount of water and 3% salt. The use of the 3% salt solution does not adversely affect the percentage of power reaching the load, however the prototype using the 25% salt solution though possessing a desirable technical evenness rating does decrease percent of moderated power to the load to an undesirable degree.

While particular embodiments of the present invention have been illustrated and described, it will be obvious to those skilled in the art that various changes and modifications can be made without departing from the spirit and scope of the invention and it is intended to cover in the appended claims all such modifications and particularly all types of enclosures which are within the scope of this invention.

What is claimed is:

1. Cookware for cooking foods evenly in a microwave oven comprising a vented enclosure transmissive of microwave energy, being microwave oven compatible up to at least 150° C., said enclosure having an inner layer of liquid of from 4 to 120 mg./cm.$^2$, retained by a liquid film forming layer held within said enclosure, said enclosure having an adjusted technical evenness of greater than zero for 10 minutes and a technical evenness rating above 0.3.

2. The cookware of claim 1 wherein the moderated power is above 80%.

3. The cookware of claim 1 wherein said film forming layer is an absorptive layer.

4. The cookware of claim 3 wherein said enclosure including an outer layer of polymeric film.

5. The cookware of claim 4 wherein said absorptive layer is attached to said outer film layer.

6. The cookware of claim 4 wherein said film and said absorptive layer being integral.

7. The cookware of claim 4 wherein said film layer is a plastic bag.

8. The cookware of claim 7 wherein said absorptive layer is from 0.08 to 1.4 millimeters thick.

9. The cookware of claim 7 wherein said absorbent layer retains an aqueous solution of from 30 to 60 mg./cm.$^2$.

10. The cookware of claim 9 wherein said aqueous solution is water.

11. The cookware of claim 9 wherein said aqueous solution is electrolyte and water.

12. The cookware of claim 11 wherein said aqueous solution has from 3 to 25% salt by weight.

13. The cookware of claim 12 wherein said salt solution has 3% salt by weight.

14. The cookware of claim 9 wherein the absorptive capacity of said absorptive layer is from 30 to 60 mg./cm.$^2$.

15. The cookware of claim 7 wherein said absorbent layer retains a layer of vegetable oil.

16. The cookware of claim 7 wherein said cookware includes an inner plastic layer internal of said absorbent layer, said absorbent layer being sandwiched between said bag and said inner plastic layer.

17. The cookware of claim 7 wherein said bag has a flap and strap closure.

18. The cookware of claim 7 having an opening for the addition of liquid.

19. The cookware of claim 7 wherein said enclosure having a reflectivity greater than 0.5% and an absorptivity greater than 4%.

20. The cookware of claim 1 and wherein said liquid is a continuous liquid film.

21. The cookware of claim 1 and wherein said film forming layer being a water soluble wetting agent coated on the inner surface of the enclosure, said liquid layer collecting on said inner surface.

22. The cookware of claim 21 wherein said cookware has a reflectivity of at least 0.2%.

23. The cookware of claim 22 being a plastic bag.

24. The cookware of claim 23 wherein said bag has a flap and strap closure.

25. The cookware of claim 23 wherein said film forming layer is in fluid communication with the interior of the bag.

26. The cookware of claim 21 wherein said cookware has an absorptivity of from 0.6 to 5%.

27. The cookware of claim 1 having a technical evenness rating of greater than 0.35.

28. The cookware of claim 27 having a technical evenness rating greater than 0.4.

29. The cookware of claim 28 having a technical evenness rating greater than 0.5.

30. The cookware of claim 1 wherein said enclosure is made of polypropylene.

31. The cookware of claim 1 wherein said liquid is maintained on both sides of said cooking food.

32. The cookware of claim 1 wherein said liquid is arranged in a pattern of spaced microwave interactive moderating regions having a technical evenness rating of at least 0.3.

33. Cookware for cooking foods evenly in a microwave oven comprising a vented enclosure transmissive of microwave energy, being microwave oven compatible above 150° C., said enclosure having an inner layer of liquid of from 4 to 120 mg./cm.$^2$, retained by an absorptive liquid film forming layer held within said enclosure, said enclosure having an adjusted technical evenness of greater than zero for 10 minutes and a technical evenness rating above 0.3.

34. The cookware of claim 33 wherein the moderated power is above 80%.

35. The cookware of claim 33 wherein said enclosure including an outer layer of polymeric film.

36. The cookware of claim 35 wherein said absorptive layer is attached to said outer film layer.

37. The cookware of claim 35 wherein said film and said absorptive layer being integral.

38. The cookware of claim 35 wherein said film layer is a plastic bag.

39. The cookware of claim 38 wherein said absorptive layer is from 0.08 to 1.4 millimeters thick.

40. The cookware of claim 38 wherein said absorbent layer retains an aqueous solution of from 30 to 60 mg./cm.$^2$.

41. The cookware of claim 40 wherein said aqueous solution is water.

42. The cookware of claim 40 wherein the absorptive capacity of said absorptive layer is from 30 to 60 mg./cm.$^2$.

43. The cookware of claim 38 having an opening for the addition of liquid.

44. The cookware of claim 33 having a technical evenness rating of greater than 0.35.

45. The cookware of claim 33 wherein said enclosure is made of polypropylene.

46. The cookware of claim 33 wherein said liquid is maintained on both sides of said cooking food.

47. The cookware of claim 33 wherein said liquid is arranged in a pattern of spaced microwave interactive moderating regions having a technical evenness rating of at least 0.3.

* * * * *

UNITED STATES PATENT AND TRADEMARK OFFICE

CERTIFICATE OF CORRECTION

PATENT NO. : 4,316,070

DATED : February 16, 1982

INVENTOR(S) : ROBERT L. PROSISE, ALGIS S. LEVECKIS, CHARLES L. GUNN

It is certified that error appears in the above-identified patent and that said Letters Patent are hereby corrected as shown below:

Cover sheet, the following should be added --
Assignee: The Procter & Gamble Company
Cincinnati, Ohio --.

Cover sheet, the following should be added --
Attorney, Agent, or Firm -- John V. Gorman, Richard C. Witte, Thomas H. O'Flaherty --.

Cover sheet, under ABSTRACT, line 4, "surfaces"should read -- surfaces --.

Column 3, line 29, "these" should read -- three --.

Column 5, line 56, "known" should read -- know --.

Column 13, line 43, ".5(.57)" should read -- .38(.43) .5(.57) --.

Signed and Sealed this

Twentieth Day of July 1982

[SEAL]

Attest:

GERALD J. MOSSINGHOFF

Attesting Officer

Commissioner of Patents and Trademarks